United States Patent [19]

Bakker et al.

[11] Patent Number: 4,675,571

[45] Date of Patent: Jun. 23, 1987

[54] COLOR DISPLAY TUBE

[75] Inventors: Gijsbertus Bakker; Rorije J. Gerhardus, both of Eindhoven, Netherlands

[73] Assignee: U.S. Philips Corporation, New York, N.Y.

[21] Appl. No.: 607,328

[22] Filed: May 4, 1984

[30] Foreign Application Priority Data

Dec. 6, 1983 [NL] Netherlands ..... 8304181

[51] Int. Cl.[4] ..... H01J 29/10

[52] U.S. Cl. ..... 313/461; 313/473

[58] Field of Search ..... 220/2.1 A; 358/245, 358/246, 247, 254; 313/477, 470, 473, 461, 466, 408

[56] References Cited

U.S. PATENT DOCUMENTS

| | | | |
|---|---|---|---|
| 3,089,052 | 5/1963 | Bisbing | 220/2.1 A |
| 3,931,906 | 1/1976 | Bradu | 220/2.1 A |
| 3,988,632 | 10/1976 | Dietch | 313/408 |
| 4,039,701 | 8/1977 | Benthem et al. | 427/68 |
| 4,128,790 | 12/1978 | Steeghs | 313/408 |
| 4,160,187 | 7/1979 | Say et al. | 313/470 |
| 4,210,935 | 7/1980 | Mitchell et al. | 358/246 |

*Primary Examiner*—David K. Moore

*Attorney, Agent, or Firm*—Robert J. Kraus

[57] ABSTRACT

A color display tube comprising an envelope consisting of a neck, a cone, and a flat or slightly curved display window having a skirt which is substantially parallel to the axis of the envelope. The inner surface of the display window is joined to the inner surface of the skirt via a sharply curved surface. The display window has on its inside a substantially rectangular display screen comprising a material luminescing in at least one color and over which an aluminum film is provided. Means is provided in the neck to generate at least one electron beam. By making the outer periphery of the display window extend substantially parallel to the boundary of the luminescent material of the display window, and by making the camber a'/b' of the sides of the boundary outwards smaller than 0.01, (b' being the distance measured along a straight line between the corners of the boundary and a' being the maximum distance from the boundary to the line) a display tube is obtained having a uniform, apparently rectangular edge around the display screen.

4 Claims, 6 Drawing Figures

COLOR DISPLAY TUBE

BACKGROUND OF THE INVENTION

The invention relates to a colour display tube comprising an envelope consisting of a neck, a cone, and a flat or slightly curved display window having a skirt which is substantially parallel to the axis of the envelope. The inner surface of the display window is joined to the inner surface of the skirt via a sharply curved transition surface. The display window has on its inside a substantially rectangular display screen comprising of a material luminescing in at least one colour and over which an aluminium film is provided. Means is provided in the neck to generate at least one electron beam.

Recently developed display tubes have flatter display windows, such as that described in Journal of Electronic Engineering, August 1982, p. 24. However, even in this tube which has a substantially rectangular display screen the outer contour of the display window is slightly barrel-shaped. For tubes which are placed in a cabinet and have the outer periphery of the display window partly concealed from the viewer by a fillet, this barrel shaped outer contour is not a disadvantage because the inner edge of the fillet can be made to adjoin the edge of the display screen. However, for tubes of the type having a display window which protrudes through the cabinet (so-called "push-through" mounting) where the fillet can not be used, the substantially rectangular display screen on the inner wall of the much less rectangular display window leads to dark areas above and below and on the left and on the right of the displayed picture, which areas vary in width and are annoying to the viewer.

SUMMARY OF THE INVENTION

It is an object of the invention to provide display tube which is particularly suitable for push-through mounting and which does not exhibit the above-mentioned annoying dark areas.

According to the invention, a colour display tube of the kind mentioned in the opening paragraph is characterized in that the outer periphery of the display window is substantially parallel to the boundary of the luminescent material of the display screen and the camber a'/b' of the sides of the said boundary outwards is smaller than 0.01, b' being the distance measured along a straight line between the corners of the side, and a' being the maximum excursion of the side from the straight line. The resulting advantage is an apparently rectangular dark edge, which is uniform in width disposed around the substantially rectangular display screen. A very slightly outwardly bowed boundary of the luminescent material is more effective than a perfectly rectangular one because small imperfections in the shape of the luminescent material boundary then become less apparent.

The known barrel-shaped outer contour was assumed to be necessary for the tube to meet stringent requirements regarding implosion safety. Experiments and comparative calculations have demonstrated that a display tube having a substantially rectangular outer contour does not lose its implosion safety under either dynamic or static loads as compared with the known tube which has a substantially flat display window and a barrel-shaped contour.

A first preferred embodiment of a colour display tube in accordance with the invention is characterized in that the boundary of the luminescent material of the display screen coincides substantially with a line joining the points where the flat or slightly curved inner surface of the display window merges with the sharply curved surface. In this manner an optimal size of the display screen on the display window is obtained. This can be used not only for tubes which are installed in sets with push-through mounting, but also for tubes in which the edge of the tube is covered by a fillet. This is of importance for tubes having black matrix material between the elements of luminescent material of the display screen, in which the matrix material extends to beyond the boundary of the luminescent material of the display screen. However, this is also of importance for tubes without the matrix material in which an aluminium film (metal backing) is provided over the luminescent material and extends to beyond the boundary of the luminescent material. In the former case (matrix), without the use of the invention, a wide dark edge is formed, and in the latter case a shining edge (aluminium) is formed which is surrounded by a dark edge caused by the skirt.

By using the invention, only a narrow dark edge which has the same width substantially everywhere is obtained which even emphasizes the rectangularity of the display screen. Moreover, the narrow dark edge which has the same width substantially everywhere, in an operating tube leads to a picture presentation which is attractive to the viewer. Notably, the edge does not result in a perceptive distortion of, for example, a number of straight columns of digits displayed on the display screen. In a non-operating tube the narrow edge which has the same width substantially everywhere around the display screen leads to an aesthetic design.

A further preferred embodiment of a colour display tube in accordance with the invention is characterized in that the sharply curved surface has a radius of curvature between 5 and 10 mm. As a result of this the narrow edge which has the same width substantially everywhere around the display screen is determined substantially only by the glass thickness due to the small radius of curvature of the curved transition surface.

If, moreover, the corners of the boundary of the luminescent material are rounded off, the rounding-off corner being between 3 and 7 mm, a very attractive picture frame is obtained. Moreover, defects which occur during providing the luminescent material in the corners as a result of insufficient adhesion to the window, are prevented.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
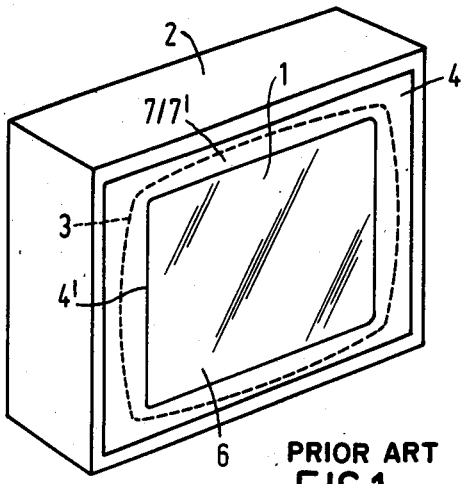
PRIOR ART FIG.1
FIG. 1 is a perspective view of a prior art television set having a fillet around the display screen.

FIG. 1 is a perspective view of a prior art television set. A display tube having a display window 1 is connected in a cabinet 2 by means of suspension means not shown. This tube comprises a substantially rectangular display screen 6 on the inner wall of the much less rectangular display window 1 which has a slightly barrel-shaped outer contour 3. As a result of this a dark edge which varies in width around the display screen 6 is formed and is covered by a fillet 4. The inner edge 4' of the fillet appears to the viewer to coincide with the boundary of the luminescent material of the display screen 6 on the inner wall of the display window 1.

Figure 2:
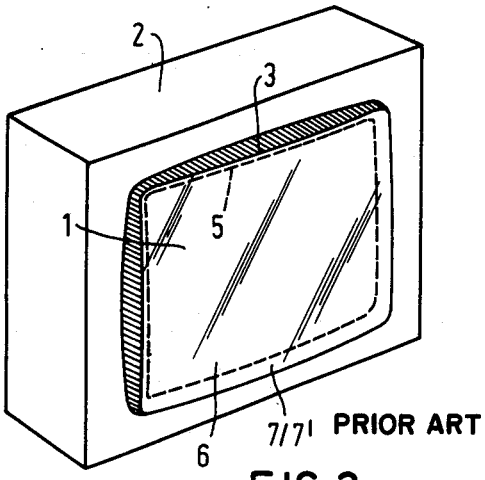
PRIOR ART FIG.2
FIG. 2 shows a prior art television set without a fillet but with push-through mounting of the display tube.

FIG. 2 is a perspective view of a television set in which a display tube of the type as used in the FIG. 1 set is used. The display window of this set slightly projects from the cabinet 2. This is the so-called push-through mounting of the display tube. The use of the fillet 4 described with reference to FIG. 1 is not possible in this way of mounting the tube. The substantially rectangular display screen 6 on the inner wall of the much less rectangular display window 1 bounded by the broken line results in dark or shining areas 7, 7' above and below and on the left and on the right of the displayed picture, which areas vary in width and are annoying to the viewer. The areas 7 and 7' are dark in the case of a matrix tube and are partly shining (area 7') in the case of a tube in which no matrix material is used. This is shown more clearly in FIG. 3 which is a front elevation of the tube as used in the FIG. 2 set. In a tube having an outside diagonal of the substantially rectangular display window of 51 cm, the distance from the boundary 5 of the display screen 6 (broken line in the Figure) to the outer contour 3 of the display window in the diagonal direction was 18.3 mm (indicated by an arrow a) and on the centres of the long and short sides it was 26.6 mm (indicated by an arrow b) and 23.8 mm (indicated by an arrow c), respectively.

Figure 4:
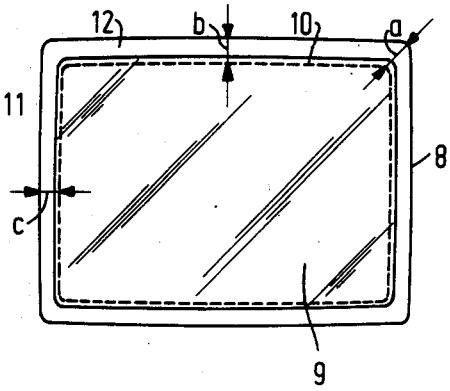
FIG. 4 is a front elevation of a display tube according to the invention.

FIG. 4 is a front elevation of a display tube according to the invention in which the outer circumference 8 of the display window 9 is substantially parallel to the boundary 10 of the luminescent material of the display screen 11. As a result of this a dark edge 12 whose width is uniform is obtained around the substantially rectangular display window 11.

Figure 3:
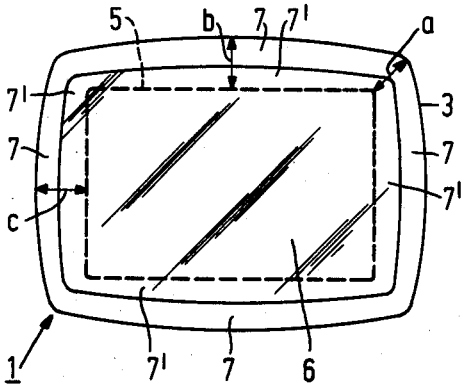
FIG.3 PRIOR ART
FIG. 3 is a front elevation of the display tube shown in FIG. 2.

The values of a, b and c defined in a manner corresponding to that of FIG. 3 are 19.5, 20.9 and 20.0 mm, respectively. In the tube according to the invention the variation in the width of the dark edge is only 1.5 mm, which is hardly visible. In the known tube the variation is well over 8 mm, which perceptively causes an annoying effect. The sides of the outer periphery 8 have a radius of curvature of approximately 6.5 m.

Figure 5:
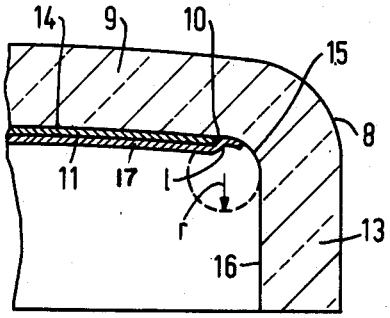
FIG. 5 is a cross-sectional view of a part of the edge and skirt of the display window of the display tube shown in FIG. 4.

FIG. 5 is a cross-sectional view of a part of the edge and skirt 13 of the display window 9 of the display tube shown in FIG. 4. The inner surface of the display window 9 changes into the inner surface 16 of the skirt 13 via a sharply curved surface 15. The radius of curvature of the sharply curved surface 15 is preferably between 5 and 10 mm and in this case is approximately 6 mm. The boundary 10 of the luminescent material of the display screen 11 coincides substantially with a line 1 which adjoins the points where the surface 14 of the display window 9 changes into the surface 15. The conventional thin aluminium film 17 is vapour-deposited over the luminescent material of the display screen 11. As a result of the small radius of curvature of the sharply curved surface 15 and the bowed boundary of the luminescent material of the display screen 11, the aluminium film 16 (viewed from the front of the tube) is hardly visible or is visible only as a very narrow line. In the case of a matrix tube the part of the aluminium film extending beyond the boundary 10 is hidden from the viewer's eye by black matrix material. It may be seen from FIG. 4 that in that case the dark edge widens only to a very small extent.

Figure 6:
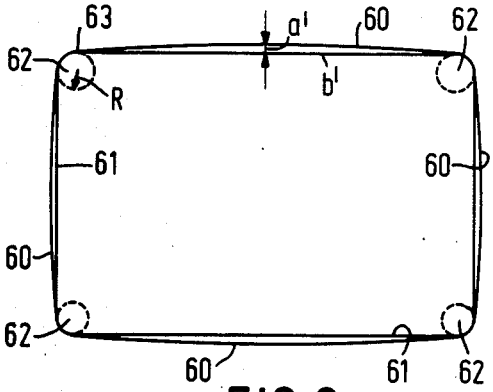
FIG. 6 is an elevation of the camber of the sides of the display screen, as well as the rounding off of the corners.

FIG. 6 is an elevation of a display screen. The boundary 60 of the luminescent material which is provided on a display window, not shown, is substantially rectangular. The camber a'/b' outwards on the sides of the boundary 60 is smaller than 0.01, b' being the distance between the corners 62 of the boundary measured along a straight line 61 and a' being the maximum distance from the boundary to the line 61. If the corners of the boundary of the luminescent material are rounded off with a rounding-off radius R which is preferably between 3 and 7 mm and which in this case is 4 mm, the distance b' is measured between the points 63 where the rounding-off begins. In the table below, values a', b' and a'/b' are recorded for the long sides (LS) and the short sides (SS) of the display screen of a 26" prior art tube and for three tubes according to the invention (PHILIPS models 66 FS, 59 FS and 51 FS).

| | | a' (mm) | b' (mm) | a'/b' |
|---|---|---|---|---|
| 26" | LS | 9.50 | 473.2 | 0.0201 |
| | SS | 4.75 | 337.8 | 0.0144 |
| 66 FS | LS | 3.00 | 520.0 | 0.0058 |
| | SS | 2.25 | 390.0 | 0.0058 |
| 59 FS | LS | 2.50 | 464.0 | 0.0054 |
| | SS | 2.00 | 348.0 | 0.0057 |
| 51 FS | LS | 2.00 | 400.0 | 0.0050 |
| | SS | 1.75 | 300.0 | 0.0058 |

By causing the outer circumference of the display window to extend substantially parallel to the boundary of the luminescent material, which is bowed outwards very slightly, a uniform, substantially rectangular edge around the substantially rectangular display screen is obtained.

For further information reference is made to the simultaneously filed Netherlands Patent Application Nos. 8,304,178 corresponding to U.S. application Ser. No. 607,321 filed May 4, 1984, 8,304,179, corresponding to U.S. application Ser. No. 607,359 filed May 4, 1984, and 8,304,180 corresponding to U.S. application Ser. No. 607,323 filed May 4, 1984 which are hereby incorporated by reference.

What is claimed is:

1. A color display tube comprising an envelope including a neck, a cone, and a substantially rectangular display window having a substantially flat portion with an inner surface bearing a luminescent screen and having a peripheral skirt extending substantially perpendicularly from said flat portion, each side of said skirt being slightly outwardly bowed;

characterized in that the luminescent screen's boundary is proximate and substantially parallel to the skirt, each side of said boundary being slightly outwardly bowed and having a camber a'/b' which is smaller than 0.01, where b' is the distance measured along a straight line between the ends of said side, and where a′ is the maximum deviation of said side from said straight line.

2. A color display tube as in claim 1 where the inner surface of the substantially flat portion of the display window is joined to an inner surface of the skirt by a sharply-curved surface, and where the ends of each side of the luminescent screen boundary substantially coincide with points where the inner surface of the substantially flat portion merges with the sharply-curved surface.

3. A color display tube as in claim 2 where the sharply-curved surface has a radius of curvature between approximately 5 and 10 millimeters.

4. A color display tube as in claim 1, 2 or 3 where each corner of the luminescent screen boundary is rounded and has a radius of curvature between approximately 3 and 7 millimeters.

* * * * *